United States Patent [19]

Bowles

[11] 4,215,744

[45] Aug. 5, 1980

[54] HEAT EXCHANGER

[75] Inventor: Vernon O. Bowles, Naples, Fla.

[73] Assignee: Solartrap, Inc., Naples, Fla.

[21] Appl. No.: 920,849

[22] Filed: Jun. 30, 1978

[51] Int. Cl.³ ..... F23F 9/02; F28F 9/24

[52] U.S. Cl. ..... 165/158; 165/159; 165/175

[58] Field of Search ..... 165/158, 159, 162, 173, 165/174, 175

[56] References Cited

U.S. PATENT DOCUMENTS

| | | | |
|---|---|---|---|
| 1,176,612 | 3/1916 | Snider | 165/158 X |
| 2,009,877 | 7/1935 | Dood | 165/158 X |
| 2,061,980 | 11/1936 | Price | 165/158 |
| 2,125,132 | 7/1938 | Stover | 165/173 |
| 2,268,507 | 12/1941 | Gertzon | 165/158 |
| 3,240,267 | 3/1966 | Edberg | 165/159 |
| 3,294,159 | 12/1966 | Kovalik et al. | 165/158 X |
| 3,792,729 | 2/1974 | Perry | 165/175 X |
| 3,804,161 | 4/1974 | Nowak | 165/158 |
| 4,083,707 | 4/1978 | Bivins, Jr. | 165/158 X |

FOREIGN PATENT DOCUMENTS

| | | | |
|---|---|---|---|
| 248081 | 11/1963 | Australia | 165/158 |
| 208492 | 1/1908 | Fed. Rep. of Germany | 165/158 |
| 907899 | 3/1954 | Fed. Rep. of Germany | 165/158 |
| 1116426 | 5/1956 | France | 165/158 |
| 520961 | 5/1940 | United Kingdom | 165/158 |

*Primary Examiner*—Stephen Marcus

*Attorney, Agent, or Firm*—Albert C. Johnston; Ronald A. Clayton

[57] ABSTRACT

A heat exchanger includes a hollow shell that defines an elongate shell space for circulation of a first fluid therethrough, and a plurality of elongate tubes spaced apart inside the shell to conduct a second fluid therethrough in heat exchange relation with the first fluid in the shell space. The heat exchanger further includes an improved assembly for coupling an end of the shell with adjacent ends of the tubes and for conducting the respective fluids separately into and from the tubes and into and from the elongate shell space without leakage. This assembly comprises a socket member having forward and backward socket portions and an annular shoulder portion protruding inwardly between them. The forward portion is connected in fluid-tight relation to an end of the shell and has a passageway extending through it for conducting the first fluid into or from the elongate shell space. The adjacent ends of the tubes extend past the shoulder portion into the backward socket portion and are fixed and sealed respectively in ports formed in a rigid tube support that is displaceable axially in the backward socket portion. A compressible O-ring seal is disposed in the backward socket portion between the shoulder portion and the circumferential area of the tube support outside of the tubes, and a jackscrew assembly is confined in the backward socket portion but is accessible through its backward end to displace the tube support to a position in which it compresses the O-ring seal against the shoulder to thereby isolate the tube ends from the first fluid in the shell space. A suitable piping connects the backward socket portion to a source of a second fluid to be conducted into or from the tube ends.

18 Claims, 6 Drawing Figures

H.W. OUT
H.W. IN
C.W. IN
C.W. OUT

HEAT EXCHANGER

The present invention relates to a heat exchanger and in particular to a coupling and conducting assembly for coupling each end of a heat exchanger shell to adjacent ends of a plurality of elongate tubes spaced apart inside the shell to conduct respective fluids separately into and from an elongate shell space defined by the shell and into and from the tubes without leakage therebetween.

Heat exchangers in which the improved coupling and conducting assembly of the present invention may be advantageously incorporated typically include an elongate hollow shell that defines an elongate or shell side space for circulating a first heat conducting fluid therethrough. A plurality of elongate tubes are spaced apart inside the shell and conduct a second fluid therethrough in a tube side space in heat exchange relation with the first fluid in the shell side space.

Such heat exchangers may be used in conjunction with solar energy collectors to heat fluids and/or water for use in residential, commercial and industrial buildings and also may have wide application in other fields.

Various specific heat exchanger designs are known. For example, U.S. Pat. No. 1,994,779 (McNeal) discloses a heat exchanger that includes an elongate tubular shell in which a plurality of tubes are supported in spaced relation at their ends by a disc or tube sheet having a plurality of ports in which the ends of the tubes are respectively received. Each tube sheet, which is received in one end of the tubular shell, is formed with a cylindrical extension that may connect to a source of fluid to thereby be conducted through the tubes; that is, through the tube side space. The space between the shell and the tubes; that is, the shell side space, is connected to a second source of heat conducting fluid through two pipe sections at opposite ends of the shell, the second fluid being thereby conducted in a heat exchange relation with the exterior of the tubes. An annular member is fixed to the exterior of the shell at both of its ends and a gland cooperates with this annular member to compress a packing material or ring against the outside of the cylindrical extension of the tube sheet to prevent leakage of fluid from the shell side space about the outer side of the tube sheet.

U.S. Pat. No. 2,492,409 (Worn et al.) discloses a heat exchanger having an elongate shell in which U-shaped tubes are mounted in spaced relation. Heat conducting fluid is conducted to the shell at one of its ends and is removed at an opposite end. However, fluid is conducted to and from the tubes at the same end of the shell. The ends of the tubes are sealed in a support or tube sheet, the circumferential margin of which is confined in a countersink formed in a flange welded onto the shell of the exchanger. An abutment ring bolted to the flange holds the tube sheet securely in place and also confines a gland ring forming part of an annular packing assembly between the periphery of the tube sheet and the mating side wall of the countersink by the action of jackscrews threadedly engaged with the gland ring, and thereby prevents leakage from the tube side space to the shell side space.

Heat exchange apparatus of the types disclosed in the McNeal and Worn et al. patents have not been widely accepted in solar energy collection systems for two primary reasons.

1. They are ordinarily of great weight and high cost when of sufficient size to adequately heat fluids for residential or more energy demanding uses.

2. Potentially hazardous contamination of drinking water can occur if there is leakage between the heat conducting fluid circulated through a solar energy collector and the shell side space and drinking water circulated through the tube side space.

The second of these reasons has been minimized by providing a surge and open vent chamber in the circulatory system for the heat conducting fluid. Since the drinking water system is usually operated at relatively high pressure, any intersystem leakage is from the drinking water system to the heat conducting fluid system. It has also been suggested that non-toxic heat conducting fluids may be used.

Despite remedies proposed for the second of the two problems noted above, most commercially available heat exchangers are still prohibitively expensive for common use in residential solar energy collection applications.

The principal object of the present invention is to provide an improved heat exchange apparatus, which may be used with particular advantage in solar energy collecting systems, that may be made of relatively inexpensive materials and that incorporates an improved assembly for preventing leakage between the tube side space and the shell side space. Moreover, this improved assembly permits economical assembly of the heat exchanger components to reduce the cost of its manufacture. The materials from which this heat exchanger may be made are also selected to provide an efficient yet low cost unit.

The heat exchanger of the invention includes a hollow shell that defines an elongate shell side space for circulation of a first heat conducting fluid therethrough. A plurality of elongate tubes are spaced apart inside the shell to conduct a second fluid therethrough in a tube side space in heat exchange relation with the fluid in the shell side space. A coupling and conducting assembly at each end of the shell couples an end thereof with adjacent ends of the tubes and conducts the respective fluids separately into and from the tube side space and into and from the shell side space without leakage. This improved coupling and conducting assembly includes a socket member that comprises forward and backward socket portions and an annular shoulder portion protruding inwardly between them. The shell includes a stub pipe, which extends into and is sealed to the inner side of the forward socket portion, and a relatively long pipe, the long pipe and the stub pipes at each end of the heat exchanger being interconnected by short shell coupling members. The adjacent ends of the tubes extend past the shoulder portion into the backward socket portion and are fixed and sealed respectively in a plurality of ports formed in a rigid tube support, or "tube sheet", that is displaceable axially in the backward socket portion.

A compressible O-ring seal is disposed in the backward portion between the shoulder portion and a circumferential area of the tube support outside the outermost tubes. This O-ring seal is compressed between the tube support and the shoulder portion, to isolate the tube side space from the shell side space, by a jackscrew assembly which includes a jackscrew washer confined in the backward socket portion and at least one jackscrew, threaded through the washer and bearing against lands of the tube support, that is accessible through the backward end of the backward socket portion. Another pipe section extends into the inner side of the backward socket portion to confine the jackscrew assembly therein and to conduct a second fluid into and from the tube ends.

The components of the heat exchanger and particularly the coupling and conducting assembly described above may be fabricated easily from readily available materials which are durable and yet economical. Moreover, the components may be easily assembled to further achieve economies making this heat exchanger particularly suitable for use in domestic solar energy collection applications as well as in a broad range of other applications. This heat exchanger is typically used in a counter current mode with fluid flowing through the shell side space in an opposite direction to achieve highly efficient heat exchange therebetween.

Other objects, features and advantages of the invention will be pointed out in or will be understood from the following detailed description and the accompanying drawings of illustrative embodiments.

IN THE DRAWINGS

Figure 1:
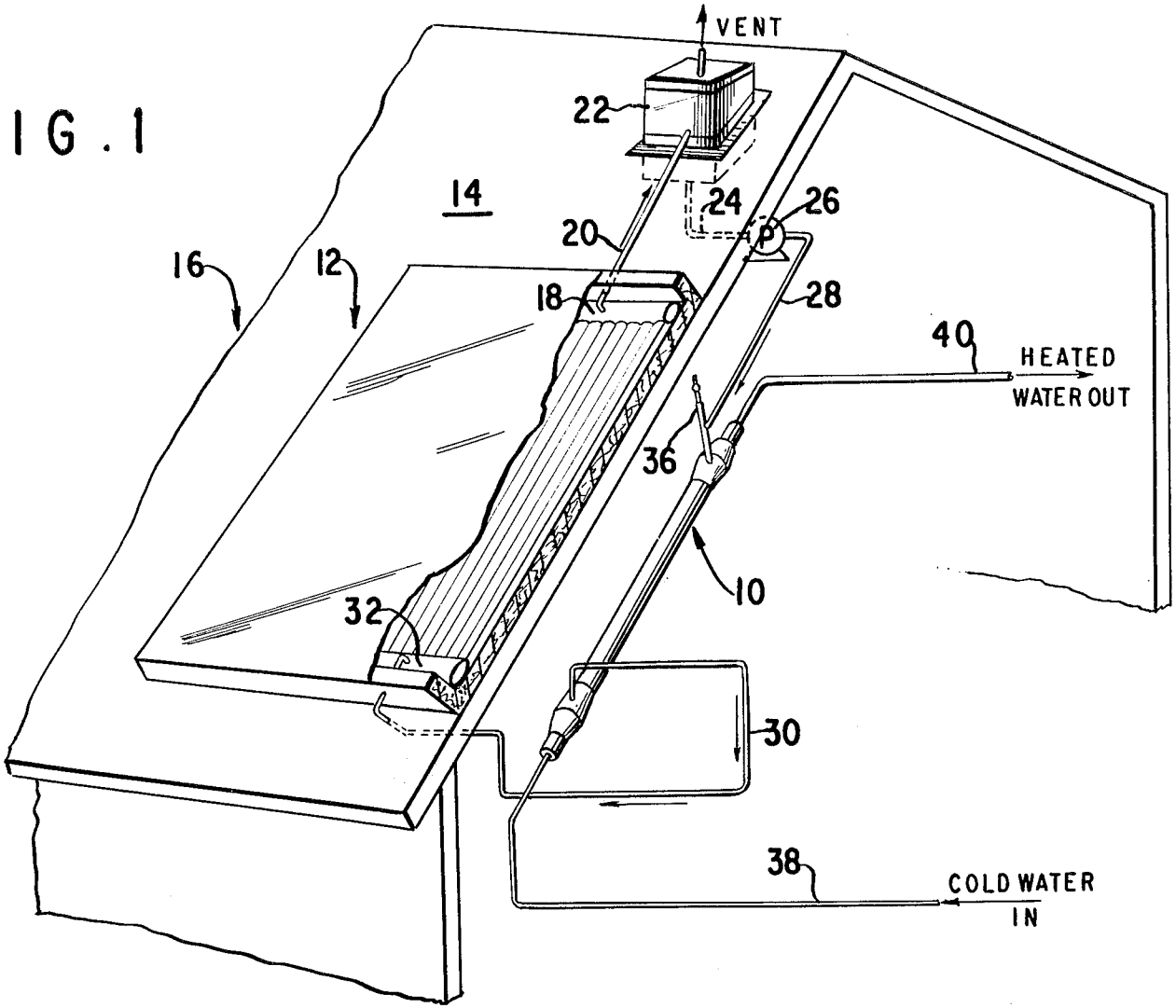
FIG. 1 is a diagramatic perspective view of a heat exchanger of the present invention which forms a part of a solar energy collecting system for heating domestic water.

FIG. 1 illustrates a heat exchanger of the present invention, generally indicated at 10, installed in a solar energy collecting system for heating domestic water. This system includes a solar collector, generally indicated at 12, that may be of conventional design or may be constructed in accordance with copending application Ser. No. 676,159, now abandoned, which is installed on the roof 14 of a building 16 to be exposed to the sun for relatively long periods of time during the solar day. In the Northern Hemisphere such collectors are generally mounted to be south-facing.

The collector 12 is designed to heat a heat conducting fluid that circulates upwardly therethrough to be received in an outlet header 18 and conducted to an outlet pipe 20 leading to a surge and expansion tank 22 that is mounted above the collector and is vented to the atmosphere. The surge and expansion tank 22 is used to fill the solar collector system with heat conducting fluid and permits entrapped gases to escape to atmosphere.

A first intermediate connecting pipe 24 carries the heat conducting fluid to a pump 26 from the bottom of the tank 22 where air or gases may be vented from the solar collector fluid system. The heat conducting fluid is forced by the pump 26 through a second intermediate connecting pipe 28 to the shell side space of the heat exchanger 10 at the elevated end of the exchanger, and from the shell side space at the lower end of the heat exchanger through a return pipe 30 to an inlet header 32 in the solar collector 12.

In the preferred embodiment, the pump 26 is mounted at an elevation below the inlet to the heat exchanger 10 which is provided with a vent 36 for releasing entrapped gases from the elevated end of the exchanger immediately upstream of its heat conducting fluid inlet.

The heat exchanger 10 is also connected to a residential, commercial or industrial hot water space heating or hot water system that comprises an inlet pipe 38 connected to the lower end of the exchanger and an outlet pipe 40 leading from the elevated end of the exchanger. As can be seen in FIG. 1, the heat conducting fluid circulates from the elevated to the lower end of the heat exchanger while the water being heated circulates from the lower to the elevated end. Thus, the heat exchanger is used in the highly efficient countercurrent mode.

Figures 2, 3, 4, 5, 6:
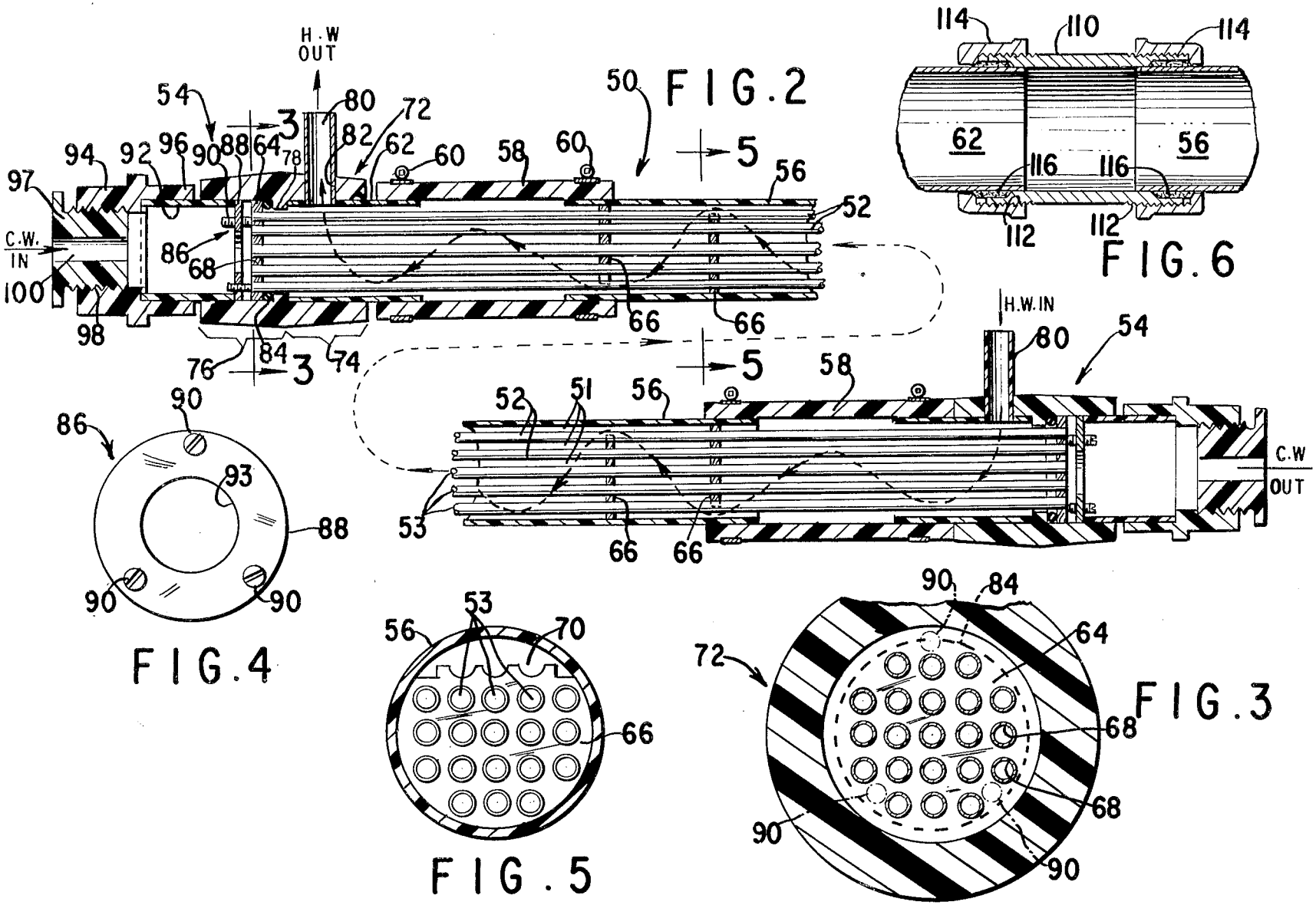
FIG. 2 is a vertical cross-sectional view of the heat exchanger, showing details of the improved shell, the tube bundle and the coupling and connecting assembly.
FIG. 3 is a vertical cross-sectional view taken through plane 3—3 in FIG. 2, showing a face of the tube support and the positions of three jackscrews relative thereto.
FIG. 4 is a front view of the assembly of the jackscrew washer and jackscrews used in the present embodiment.
FIG. 5 is a vertical cross-sectional view taken through plane 5—5 in FIG. 2, showing one baffle/tube support mounted in the interior of the shell.
FIG. 6 is an enlarged vertical cross-sectional view of an alternative shell coupling member structure which is used in most applications.

Referring now to the detailed illustration of FIG. 2, the heat exchanger of the present invention comprises a plastic shell assembly 50 that defines an elongate shell side space 51 through which the heat conducting fluid may be circulated. A tube bundle containing twenty-one elongate brass or copper tubes 52, collectively defining a tube side space 53, is disposed inside the shell assembly to conduct water to be heated therethrough in heat exchange relation with the heat conducting fluid circulated through the shell side space. The shell assembly and the tube bundle are coupled at their respective, adjacent ends by identical coupling assemblies, generally indicated at 54, that seal the shell side space from the tube side space and prevent leakage therebetween. Since the assemblies are identical, a detailed description of one provided below will serve to describe both.

As shown in FIG. 2, the shell assembly 50 comprises a long shell pipe 56 that is a section of two inch (nominal) diameter PVC pipe having a length of approximately 58½ inches and a wall thickness of approximately ⅛ inch. At each of its ends, the long pipe is connected in fluid-tight relation to a relatively short shell coupling member 58, which may be a marine exhaust hose of 2⅜ inches inside diameter and approximately 5½ inches in length, secured by a suitable clamp 60 such as a worm drive hose clamp. At its end opposite the long pipe, the shell coupling member is coupled to a shell stub pipe 62 also made of PVC pipe having a wall thickness of approximately ⅛ inch, diameter of two inches (nominal), but length of approximately 3 inches. The stub pipes at opposite ends of the shell assembly are connected to the coupling assembly 54 in a manner to be described below in detail.

An alternative coupling assembly, shown in FIG. 6, known as a threadless or "Dresser" coupling, may be preferable in most applications and includes a coupling member 110 having opposing outwardly threaded ends 112 which receive threaded compression bells 114. The bells and ends of the connector member are formed to cooperatively define an annular space 116 in which a molded gasket is received. When the bells 114 are tightened onto the coupling member, the gasket is compressed radially against the exterior of the stub pipes 62 and long pipe 56 to effect the respective seals. Differential expansion between the tube bundle and the shell assembly is accommodated by the coupling members of either the first or second alternative coupling assemblies when the heat exchanger of the invention is in operation.

Each of the tubes 52 mounted in the exchanger assembly is made of a material having high heat conductivity and high corrosion resistance such as brass or copper and, for example, is approximately 6 feet long and ¼ inch in diameter. The tubes are assembled into a bundle and are held in spaced relation by two tube supports 64 each mounted in one coupling assembly 54 and by a series of baffles 66 which are positioned along the tube bundle in the shell assembly. Each tube support 64 comprises a metal disc having a plurality of ports 68 drilled therein equal to the number of tubes, in a regular pattern as shown in FIG. 3. The ends of the tubes 52 adjacent one end of the tube bundle assembly are sealed respectively in the ports 68 of the tube support in a manner to be fluid-tight, as described in greater detail below.

The baffles 66, shown in detail in FIG. 5, are also formed with a plurality of holes in the same pattern as that of the tube supports. However, one edge of each baffle has an open segment as at 70 that permits fluid flowing in the shell side space to pass thereby. As shown in FIG. 2, a plurality of baffles support the tubes in the shell long pipe 56 with the open segment of adjacent baffles arranged 180° apart. Therefore, fluid circulating in the shell side space undulates across the tubes to ensure efficient heat exchange.

The coupling assembly for linking adjacent ends of the tube bundle and the shell assembly to prevent leakage between shell side and tube side spaces comprises a socket member 72 made of a suitable molded plastic, which includes a forward socket portion 74, a backward socket portion 76, and an annular shoulder portion 78 that protrudes inwardly between the forward and backward portions. The stub pipe 62 is received in the forward socket portion and is sealed in fluid-tight relation thereto by any suitable adhesive or sealing compound. Fluid communication between the shell side space and the pipes 28 and 30 is established by inlet or outlet tubular connectors 80 that are cemented into holes 82 drilled radially through the side wall of the forward socket portion 72 and the stub pipe 62.

As can be seen in FIGS. 2 and 3, the tube support 64 is positioned in the backward socket portion 76 and is slightly smaller in diameter than the inner diameter thereof. A compressible seal in the form of an O-ring 84 is positioned between the backward face of the shoulder portion 78 and a circumferential area of the tube support outside of the outermost tubes 52. This O-ring is compressed to form a fluid-tight seal by a "floating" jackscrew washer assembly also disposed in the backward socket portion 76.

The jackscrew washer assembly, generally indicated at 86 and shown in FIGS. 2 and 4, comprises an annular jackscrew washer 88 having an outside diameter only slightly smaller than the inside diameter of the backward socket portion and is confined in the backward socket portion by the forward end of a pipe section 92 which extends into and is sealed in the inner side of the backward socket portion, as shown in FIG. 2, by a suitable heavy duty adhesive or sealing compound. Three jackscrews 90 are threaded through the washer 88 and bear against the tube support at locations between ports 68 as shown in FIG. 3, and when tightened compress the O-ring 84 between the circumferential area of the tube support and the annular shoulder portion to effect the liquid-tight seal therebetween. As shown in FIGS. 2 and 4, the washer has a central hole 93 that permits the second fluid to be circulated to the tube side plenum space. Further, the spacing between the washer and the tube support permits this circulated fluid to reach tubes at the outer boundary of the bundle.

The heat exchanger 10 is completed by a connector arrangement for conducting fluid to be heated to the tube side plenum space, that includes a rigid tubular sleeve 94 which has a forward portion 96 engaged with and sealed to the backward portion of the pipe section 92. A closure member 97 is received in a threaded backward portion 98 of the sleeve 94 and has a port 100 for conducting the second fluid to be heated to the tube side plenum space.

It will be appreciated from the above description that the apparatus of the present invention incorporates a simple assembly for sealing the shell side and tube side fluid spaces to prevent leakage therebetween. Moreover, the simplicity of this invention permits it to be economically fabricated and assembled in a cost effective manner so that it may be incorporated with advantage into many applications including residential solar energy collection systems.

Although the preferred embodiment comprises a heat conducting metallic tube bundle disposed in a plastic shell and coupling and conducting assembly, the features of the invention can be realized with other materials. For example, the heat exchanger of the invention may incorporate metallic shells and conducting and coupling assemblies. The features of the present invention will be appreciated more fully from the following description of the manner in which the heat exchanger of the invention is assembled.

The long pipe 56 is first assembled with two coupling members disposed completely over each of its ends using either the threadless coupling arrangement or a marine exhaust hose with worm drive hose clamps 60 such as shown respectively in FIGS. 6 and 2.

Stub pipes 62 are sealed in the forward socket portions 72 of respective socket members 54 and holes 82 are drilled radially through the forward socket portions and stub pipes to receive inlet or outlet connectors 80 that are cemented therein in fluid-tight relation.

Twenty-one tubes 52 are then assembled in the spaced array or tube bundle shown in FIGS. 2, 3 and 5 by being respectively received in the pattern defining holes of nine baffles 66 which are mounted so that open segments 70 of adjacent baffles are 180° apart. A tube support 64 is mounted on one end of the tube bundle, the respective tube ends being received in ports 68, with the socket member and stub pipe assembly interposed between the tube support and the adjacent baffle. The tubes are preferably allowed to project ⅛ inch through the tube support so that they may be sweated into the tube support with solder. (Alternatively, the tubes may be roller-expanded into the tube support.) After the tubes have been sweated to the support, the remainders of the tubes projecting through the support are ground to be flush with the support face and to remove excess solder. In this manner a smooth, fluid-tight seal between the tube support and the ends of the tubes is achieved.

The tube baffles are then spaced approximately equally along the length of the tubes and are spot soldered to a limited number of selected tubes to prevent their movement during further assembly steps and during heat exchanger operation.

The portion of the shell assembly comprising the long pipe 56 with the connector members disposed thereon is then slipped over the tube bundle-baffle assembly. This long pipe assembly is slid along the tube bundle until long pipe 56 abuts against stub pipe 62 to provide space for the assembly operation which follows. A second fluid coupling and conducting assembly, which includes a stub pipe 62 inserted in a socket member provided with an outlet or inlet connector in the manner described above, is positioned at the opposite end of the shell assembly with its stub pipe temporarily abutting against long pipe 56. A second tube support is mounted with the free tube ends received in its respective ports and is sweated or otherwise sealed thereto and is completed in the manner described above. O-rings are then slipped over each tube support and around the tubes at each end of the tube bundle to be interposed between a circumferential portion of each tube support and the annular shoulder portion of each socket member.

One jackscrew washer, into which three jackscrews are threaded with a fluid locking compound applied to the jackscrews to prevent their loosening after assembling and during exchanger operation, is inserted into the backward socket portion of one socket member. The jackscrew washer is oriented so that the jackscrews bear against solid portions of the tube support and do not interfit with any ports, as shown in FIG. 3. Then, a pipe section 92 is cemented with heavy duty PVC cement into the backward socket portion of socket member 72. After the cement has had ample opportunity to set (24–48 hours), the jackscrews 90 are progressively tightened until the O-ring seal 84 is tightly compressed between the circumferential area of the tube support and the annular shoulder member in one coupling assembly. The tubular closure member may then be assembled with the pipe section, using heavy duty cement.

The assembly steps of mounting the jackscrew washer, jackscrews, pipe section and closure member are then repeated on the opposite end of the heat exchanger unit at the opposite coupling and conducting assembly. When the coupling and conducting assemblies have been completed at both ends of the heat exchanger and the O-rings have been compressed to effectuate the seals at each end, the shell coupling members previously disposed on long shell pipe 56, are slid axially onto the stub pipes 62 at each end, and are then tightened or clamped into position to effectuate a tight shell closure. This arrangement is capable of accommodating small differences in tube bundle length, the change in dimension due to O-ring compression, and, in addition, it accommodates differential expansion between the tube bundle and the heat exchanger shell during operating cycles.

The heat exchanger constructed in accordance with the present invention provides many advantages. In particular, a complete 7.5 sq. ft. (heat transfer surface) heat exchanger weighs only about 15 pounds. Thus, the mass that must be heated at the beginning of a solar day of operation is low. Moreover, a very large amount of heat exchange surface is provided per unit of exchanger volume and mass. The volume of the tube side space defined by the tube bundle and of shell side space is very low. In the preferred embodiment described above, the tube side space holds 1.89 pounds of water and the shell side space holds 6.47 pounds of water. Therefore, a minimum amount of heat is required to heat the fluid within the tubes and within the shell at the beginning of a solar day and correspondingly, less is lost at the end of each solar day, and thus greater amounts of solar heat are recovered for use.

Relatively long countercurrent flow paths for the heat conducting fluid and the fluid being heated are also provided. Therefore, the temperature of the heated fluid may closely approach that of the heating fluid. High heat transfer coefficients in the range of 90 to 100 BTU per hour per sq. ft. per degree F. at heat flux rates in the range of 12,000 BTU per hour have been achieved under conditions of low pressure drop. Also, as noted above, the cost of materials and assembly of this heat exchanger are exceedingly low.

Although a specific embodiment of the present invention has been described above in detail, it is to be understood that this is for purposes of illustration. Modifications may be made to this heat exchanger in order to adapt it to a particular solar energy collection system or to other applications.

What is claimed is:

1. In a heat exchanger including hollow shell means defining an elongate space for circulation of a first fluid therethrough, a plurality of elongate tubes spaced apart inside said shell means to conduct a second fluid therethrough in heat exchange relation with fluid in said space, and means at each end of said shell means for coupling an end thereof with adjacent ends of said tubes and conducting the respective fluids separately into or from said tubes and said space without leakage, the improvement wherein each said coupling and conducting means comprises:

a socket member comprising forward and backward socket portions and an annular shoulder portion protruding inwardly between them, said forward portion being connected in fluid-tight relation to an end portion of said shell means and having a passageway extending through it for conducting said first fluid into or from said space;

a rigid tube support displaceable axially in said backward socket portion, said tube support having a plurality of ports therein, said adjacent ends of said tubes extending past said shoulder portion into said backward socket portion and said tubes being fixed and sealed respectively in said ports of said tube support;

a compressible sealing ring in said backward portion between said shoulder portion and a circumferential portion of said tube support outside the tubes;

means confined in said backward socket portion but accessible through its backward end for displacing said tube support to a position in which it compresses said sealing ring against said shoulder portion, thereby isolating said tube ends from said first fluid space, and means connected with said backward socket portion for conducting said second fluid into or from said tube ends.

2. A heat exchanger as claimed in claim 1, said displacing means comprising a jackscrew washer assembly provided with at least one jackscrew threaded through said washer and bearing against said tube support.

3. A heat exchanger as claimed in claim 2, said means for conducting said second fluid including a pipe section extending into and sealed to the inner side of said backward socket portion, the forward end of said pipe section abutting against said jackscrew washer assembly to retain it in place.

4. A heat exchanger as claimed in claim 3, said means for conducting said second fluid further including a rigid tubular sleeve having a forward portion thereof engaged with and sealed to a backward portion of said pipe section and having a screw threaded backward portion, and a closure member threadedly engaged with said threaded backward portion, said closure member having a port therein for conducting said second fluid therethrough.

5. A heat exchanger as claimed in claim 1, said shell means including at each end thereof a stub pipe extending into and sealed to the inner side of a said forward socket portion.

6. A heat exchanger as claimed in claim 5, said shell means further including a relatively long pipe and at each end thereof a tubular coupling member coupled at its opposite ends in fluid-tight relation to, respectively, one of said stub pipes and an end of said long pipe.

7. A heat exchanger as claimed in claim 6, said long pipe and said stub pipe being lengths of plastic piping, each said socket member being a molding of plastic material, and each said tube being a length of corrosion resistant highly heat conductive metal tubing.

8. A heat exchanger as claimed in claim 1, said sealing ring being an elastic O-ring.

9. A heat exchanger as claimed in claim 1, said tube support being a perforated metal disc having said tube ends extending through and soldered in the perforations of the disc.

10. A heat exchanger as claimed in claim 1, said shell means including means to enable adjustment of the length of the shell means to accommodate displacement of said tube support relative to said shoulder portion and differential expansion between the shell and the tube bundle during operating cycles.

11. A heat exchanger as claimed in claim 1, said shell means comprising a stub pipe extending into and sealed to the inner side of said forward socket portion, a relatively long pipe, and between an end of said long pipe and said stub pipe tubular coupling means coupled at opposite ends thereof in fluid-tight relation to respectively said stub pipe and said end of said long pipe, said tubular coupling means being releasable and retightenable to accommodate variations in the tube length and differential expansion between the shell and the tube bundle during operation.

12. A heat exchanger as claimed in claim 11, said tubular coupling means including a tubular member extending between said long pipe end and said stub pipe and releasable means for clamping and sealing the opposite ends of said tubular member to adjacent end portions respectively of said stub pipe and said long pipe.

13. In a heat exchanger including hollow shell means defining an elongate space for circulation of a first fluid therethrough, a plurality of elongate tubes spaced apart inside said shell means to conduct a second fluid therethrough in heat exchange relation with fluid in said space, and means at each end of said shell means for coupling an end thereof with adjacent ends of said tubes and conducting the respective fluids separately into or from said tubes and said space without leakage, the improvement wherein each said coupling and conducting means comprises:

a socket member comprising forward and backward socket portions and an annular shoulder portion protruding inwardly between them, said shell means including a stub pipe extending into and sealed to the inner side of each said forward socket portion, a relatively long pipe, and at each end of said long pipe a tubular coupling means coupled at its opposite ends in fluid-tight relation to, respectively, the long pipe end and one of said stub pipes;

a rigid tube support displaceable axially in said backward socket portion, said tube support having a plurality of ports therein, said adjacent ends of said tubes extending past said shoulder portion into said backward socket portion and being fixed and sealed respectively in said ports of said tube support;

a compressible elastic O-ring in said backward portion between said shoulder portion and a circumferential portion of said tube support outside the tubes;

a jackscrew washer and a plurality of jackscrews threaded through said washer and bearing against said tube support, said washer being confined in said backward socket portion and said jackscrews being accessible through the backward end of said backward portion for adjustment of the jackscrews to displace said tube support to a position in which it compresses said O-ring against said shoulder portion, thereby isolating said tube ends from said first fluid space; and means connected with said backward socket portion for conducting said second fluid into or from said tube ends.

14. A heat exchanger as claimed in claim 13, said means for conducting said second fluid including a pipe section extending into and sealed to the inner side of said backward portion, the forward end of said pipe section abutting against said jackscrew washer to retain it in place.

15. A heat exchanger as claimed in claim 14, said means for conducting said second fluid further including a rigid tubular sleeve, having a forward portion thereof engaged with and sealed to a backward portion of said pipe section and having a screw threaded backward portion, and a closure member threadedly engaged with said threaded backward portion, said closure member having a port therein for conducting said second fluid therethrough.

16. A heat exchanger as claimed in claim 13, said long pipe and said stub pipes being lengths of plastic piping, each said socket member being a molding of plastic material, and each said tube being a length of corrosion resistant, highly heat conductive metal tubing.

17. A heat exchanger as claimed in claim 13, said tube support being a perforated metal disc having said tube ends extending through and soldered in the perforations of the disc.

18. A heat exchanger as claimed in claim 13, each said tubular coupling means including a tubular member extending between an end of said long pipe and a said stub pipe and releasable means for clamping and sealing the opposite ends of said tubular member to adjacent end portions respectively of the long pipe and stub pipe.

* * * * *